US006135210A

United States Patent [19]

Rivas

[11] Patent Number: 6,135,210

[45] Date of Patent: Oct. 24, 2000

[54] WELL COMPLETION SYSTEM EMPLOYING MULTIPLE FLUID FLOW PATHS

[75] Inventor: Olegario S. Rivas, Bartlesville, Okla.

[73] Assignee: Camco International, Inc., Houston, Tex.

[21] Appl. No.: 09/116,364

[22] Filed: Jul. 16, 1998

[51] Int. Cl.[7] ..... E21B 43/00

[52] U.S. Cl. ..... 166/372; 166/66.4; 166/105.5; 166/242.2

[58] Field of Search ..... 166/66.4, 105.4, 166/242.2, 242.3, 265, 313, 370, 372

[56] References Cited

U.S. PATENT DOCUMENTS

| | | | |
|---|---|---|---|
| 2,242,166 | 5/1941 | Bennett | 103/1 |
| 3,841,400 | 10/1974 | Callihan et al. | 166/120 |
| 4,502,536 | 3/1985 | Setterberg, Jr. | 166/105.5 |
| 4,589,482 | 5/1986 | Bayh, III | 166/105.5 |
| 4,624,310 | 11/1986 | Echols et al. | 166/106 |
| 4,632,184 | 12/1986 | Renfroe et al. | 166/105.5 |
| 4,898,244 | 2/1990 | Schneider et al. | 166/297 |
| 4,988,389 | 1/1991 | Adamache et al. | 166/302 |
| 5,309,998 | 5/1994 | Rivas et al. | 166/265 |
| 5,343,945 | 9/1994 | Weingarten et al. | 166/105.5 |
| 5,350,018 | 9/1994 | Sorem et al. | 166/250 |
| 5,482,117 | 1/1996 | Kolpak et al. | 166/265 |
| 5,657,821 | 8/1997 | Beauquin et al. | 166/68 |
| 5,730,871 | 3/1998 | Kennedy et al. | 166/265 X |

FOREIGN PATENT DOCUMENTS

| | | | |
|---|---|---|---|
| 2 087 458 | 5/1982 | United Kingdom | E21B 33/122 |

*Primary Examiner*—Roger Schoeppel
*Attorney, Agent, or Firm*—Fletcher, Yoder & Van Someren

[57] ABSTRACT

A technique is disclosed for completion of a well, such as an oil and gas production well. A packer is positioned in the well to divide the well into upper and lower zones. The packer has multiple passageways between the upper and lower zones. A pumping system is positioned in the lower zone for displacing wellbore fluids flowing from a production formation. The pumping system may include a liquid/gas separator, and express gas-phase components through one of the passageways and liquid-phase components through another. A conduit conveys the gas-phase components to a desired location. The liquid-phase components are conveyed to a collection location in the annular region surrounding the conduit. The conduit may be used for positioning a chemical injection line within the well, or for receiving a parameter sensing unit. The chemical injection and parameter sensing may be performed independently of gas production, and without interruption of either gas or liquid production.

24 Claims, 4 Drawing Sheets

FIG. 2
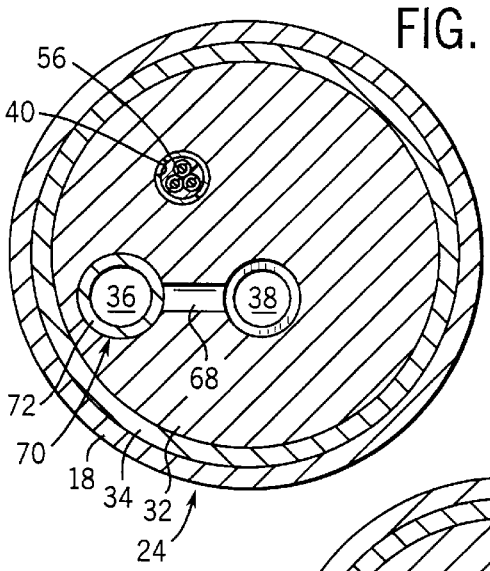
FIG. 4
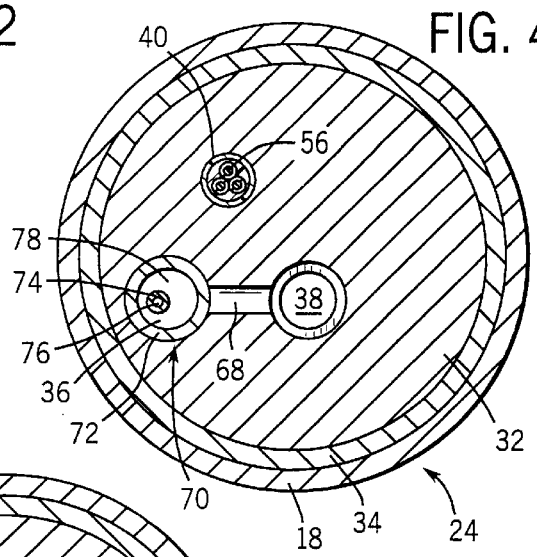
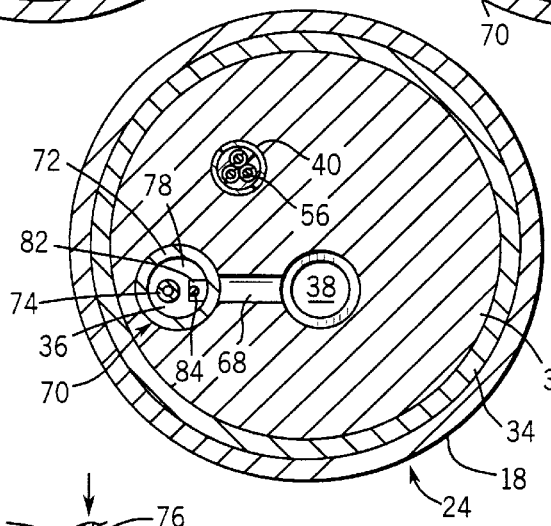
FIG. 7
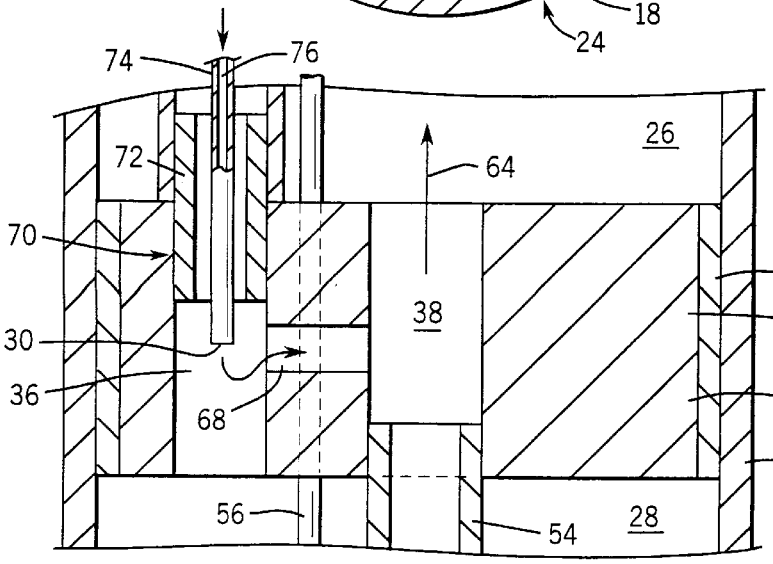
FIG. 5

WELL COMPLETION SYSTEM EMPLOYING MULTIPLE FLUID FLOW PATHS

BACKGROUND OF THE INVENTION

1. Field of the Invention

The present invention relates to the field of submersible pumping systems for producing fluids, such as petroleum and gas, from wells. More particularly, the invention relates to a technique for producing fluids from wells by means of a submersible pumping system coupled to a packer through which a plurality of fluid passages are formed. The passages permit oil and gas to be produced through the separate passages of the packer, and through fluid conduits and annular portions of the well above the packer. The invention also provides a technique for sensing parameters in the vicinity of a submersible pumping system by means of the packer, as well as for injection of chemicals and other substances through at least one of the passages formed in the packer.

2. Description of the Related Art

A variety of pumping systems have been devised and are currently in use for raising fluids from wells, such as petroleum production wells. In general, where a subterranean formation provides sufficient pressure to raise wellbore fluids to the earth's surface, the well may be exploited directly, by properly channeling the fluids through conduits and above-ground valving. However, where the subterranean formations do not provide sufficient pressure, submersible pumping systems are commonly employed for forcing wellbore fluids to the earth's surface for subsequent collection and processing.

In general, one class of submersible pumping systems includes a prime mover, typically an electric motor, coupled to a pump. The electric motor and pump are positioned within wellbore fluids and the pump is driven by the electric motor to draw the fluids into the pump and to force them, under pressure, to the earth's surface. The fluids produced by the pump may be forced upwardly through various types of conduit, such as the well casing, or production tubing, to a collection point at the earth's surface. The pumping systems may also include ancillary components, depending upon the configurations of the subterranean formations. Such components often include motor protectors for preventing wellbore fluids from mixing with fluids contained in submersible electric motors, separators for removing oil from water or gas, and injection pumps or compressors for reinjecting water or other non-production fluids into designated subterranean formations above or below the producing horizons.

In conjunction with well completion equipment, such submersible pumping systems often provide reliable means for raising production fluids, and for processing the fluids in situ. However, they are not without drawbacks. For example, submersible pumping systems configured to separate production fluids from gas are typically designed to convey oil through a central production conduit or tubing, and gas through an annular area surrounding the tubing. However, flow rates available from the pumping system may be severely limited by head losses through the tubing. In general, such head losses are a function of the length of the tubing, the tubing diameter, the fluid flow rate, and physical characteristics of the tubing surfaces. To supply adequate fluid displacement through stands of production tubing, the pumping systems may be adapted to provide enhanced pressure head, such as by increasing the number of stages in the pump. However, providing additional stages and output head from the pump generally also requires an increase in the size or rating of the electric motor used to drive the pump, along with an increase in the size or rating of power cable supplying electrical energy to the motor, ultimately resulting in increased cost and power consumption.

Other drawbacks of existing submersible pumping systems stem from their limited ability to accommodate intermittent data acquisition, chemical injection and other processes, useful from time to time in exploiting the subterranean formations. In particular, while certain instrumentation is commonly provided as a permanent part of the pumping system itself, it may be desirable in certain applications to sense wellbore or pumping system parameters only on an "as needed" bases, such as by lowering retrievable instrumentation into the well for data collection. However, this is often difficult or impossible in conventional pumping system applications, particularly where packers are used in conjunction with the pumping system or fluid conduits to isolate regions of the wellbore from one another. Such packers are typically set prior to actuation of the pumping systems, and cannot be easily traversed once the pumping system is in operation.

Similarly, it is sometimes desirable to inject chemicals or fluids in the vicinity of a subterranean formation, upstream or downstream of a submersible pump during operation. Such fluids may include anticorrosive agents, viscosity reducing agents, scale inhibitors, and so forth. However, unless dedicated chemical injection lines are provided in the pumping system during its deployment, such injection is often difficult or impossible to accommodate without removal of the pumping system from the well.

There is a need, therefore, for an improved technique for completing a fluid producing well which avoids or attenuates these drawbacks of existing systems. In particular, there is a need for a submersible pumping system capable of producing wellbore fluids more efficiently than through the production tubing techniques employed in conventional systems. There is also a need for a pumping system which can flexibly accommodate oil and gas production at efficient power levels while permitting special instrumentation, chemical injection, and other processes to be carried out on an intermittent basis without disrupting operation of the pumping system.

SUMMARY OF THE INVENTION

The present invention offers a pumping system configuration and well completion technique designed to respond to these needs. The technique may be employed with a variety of pumping unit configurations, utilizing a prime mover, such as an electric motor, coupled to a submersible pump. The pumping unit may also include a fluid/gas separator for removal of entrained or emulsified gasses from the wellbore fluids. The technique allows liquids, such as viscous oil, to be produced in an annular area surrounding a stand of conduit, such as production tubing or coiled tubing. Gas separated from the wellbore fluids may be produced through the conduit. The viscous oil is thus forced through a fluid passageway in a multi-passage packer to which the pumping system is coupled.

The cross sectional area of the annular region surrounding the conduit is preferably larger than the conduit internal cross-sectional area, permitting much higher flow rates of oil than can be obtained with conventional techniques. Moreover, the conduit is coupled to a second passageway in the packer, and may be employed for the introduction of instrumentation and chemicals on a permanent or intermittent basis during operation of the pumping system. A connection port or crossover passage may be provided in the packer between the passageways to permit fluids to be exchanged between the passageways, such as for injecting chemicals downstream of the pump.

Thus, in accordance with a first aspect of the invention, a well completion system is provided for raising fluids from a well. The system includes a packer for dividing the well into an upper zone and a lower zone. The packer has first and second passageways extending between the first and second zones. A pumping system is positioned in the lower zone. The pumping system includes a pump and a drive motor coupled to the pump. The pumping system is operative to displace fluids from the lower zone through the first passageway in the packer to the earth's surface via a first fluid path. A second fluid path is provided which is separate from the first fluid path and extends from the earth's surface to the second passageway in the packer and in fluid communication with the lower zone. The second fluid path may be used for production of a second fluid, such as gas, or may serve for positioning instrumentation or injecting chemicals at desired locations in the well.

In accordance with another aspect of the invention, a well completion system for raising fluids from a well includes a packer, a pumping system, and a fluid conduit. The packer separates the well into lower and upper zones, and has first and second passageways extending between the lower and upper zones. The pumping system is positioned in the lower zone and includes a liquid/gas separator for separating wellbore fluids into substantially gaseous components and substantially liquid components. The pumping system is operative to displace fluids from the lower zone to the upper zone via the first passageway. The fluid conduit extends from the earth's surface to the second passageway for transmitting gas from the separator to a collection location.

In accordance with still another aspect of the invention, the well completion system includes a packer, a pumping system, a fluid conduit and a chemical injection line. The pumping system is positioned in the lower zone defined by the packer for transferring wellbore fluids from the lower zone to the earth's surface via a first passageway in the packer. The fluid conduit extends from the earth's surface to a second passageway in the packer. The chemical injection line extending from the earth's surface and through the fluid conduit for injecting a chemical into the well.

The invention also provided a method for producing fluid from a well. In accordance with one aspect of the method, a completion system is positioned in the well the completion system includes a packer, a pumping system and a fluid conduit. The packer separates the well into lower and upper zones, and has first and second passageways extending between the lower and upper zones. The pumping system disposed in the lower zone and includes a pump operatively coupled to a drive motor, a discharge side of the pump being in fluid communication with the first passageway. The fluid conduit extends from the earth's surface to the second passageway. Power is applied to the motor to drive the pump and thereby to displace wellbore fluids through an annular region defined between an inner peripheral surface of the well and the fluid conduit to the earth's surface. The method may includes steps for inserting chemical injection lines or instrumentation into desired locations in the well via the fluid conduit. The fluid conduit may also serve for producing gas or other components of the wellbore fluids.

BRIEF DESCRIPTION OF THE DRAWINGS

The foregoing and other advantages and features of the invention will become apparent upon reading the following detailed description and upon reference to the drawings in which:

FIG. 2 is a sectional view of a portion of the system of FIG. 1 along line 2—2 in FIG. 1, illustrating certain of the internal components of the system;

FIG. 4 is a sectional view of a portion of the system of FIG. 3 along line 4—4 of FIG. 3;

FIG. 5 is a vertical sectional view of a portion of the system of FIG. 3, illustrating diagramatically the manner in which chemicals may be injected into an output stream of a pumping system included in the completion system;

FIG. 7 is a sectional view through a portion of the system of FIG. 6, illustrating the placement of certain of the components of the completion system.

DETAILED DESCRIPTION OF SPECIFIC EMBODIMENTS

Figure 1:
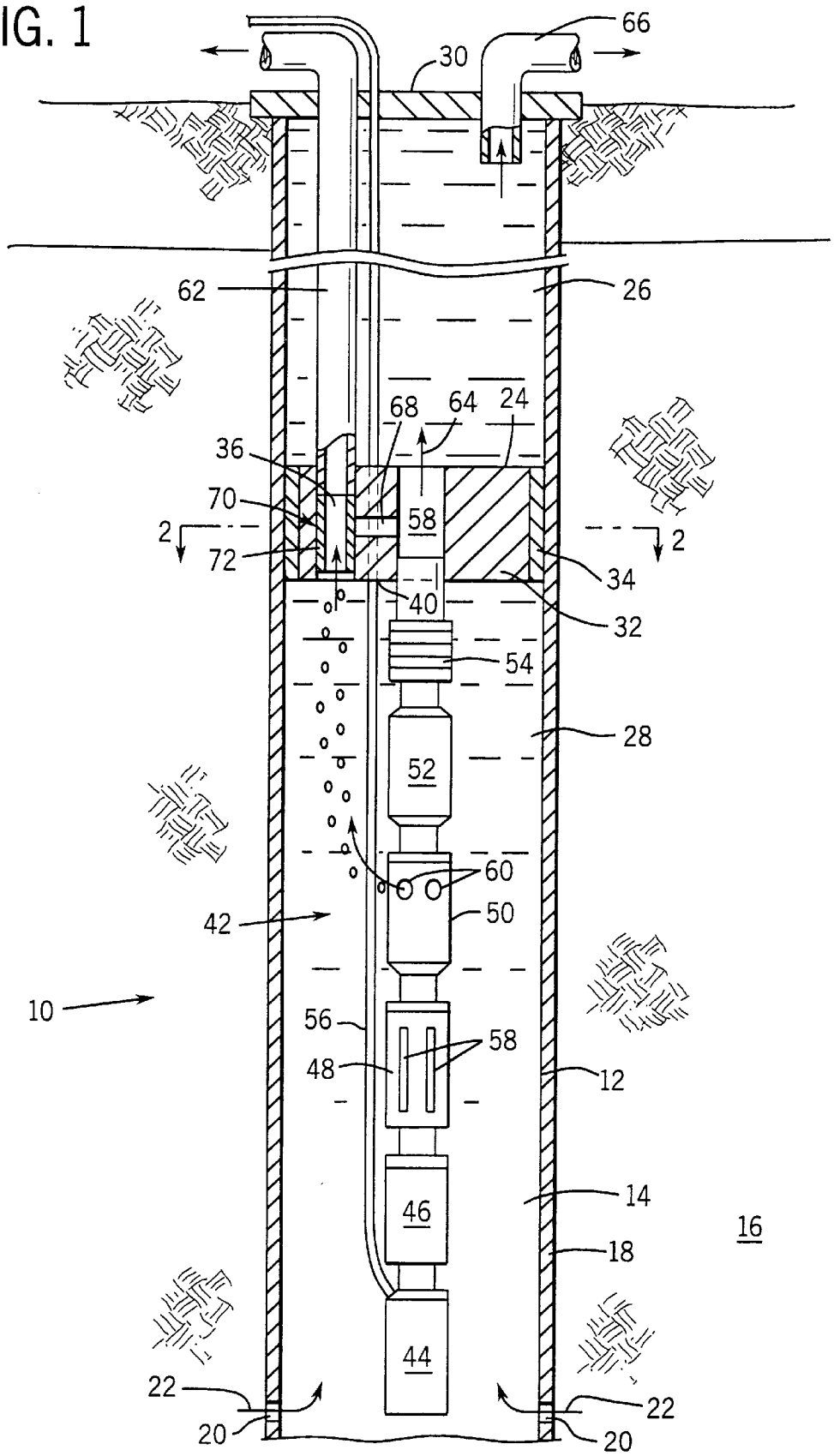
FIG. 1 is an elevational view of a well completion system in accordance with certain aspects of the present technique, deployed in a petroleum production well.

Turning now to the drawings, and referring first to FIG. 1, a completion system 10 is illustrated diagramatically. The completion system is shown deployed in a well 12 which consists of a wellbore 14 traversing one or more subterranean zones or horizons, including a production formation 16. In general, production formation 16 will include geological formations bearing fluids of interest, such as crude oil, gas, paraffin, and so forth. Wellbore 14 is defined by an annular casing 18 through which perforations 20 are formed adjacent to production formation 16. Fluids of interest flow from production formation 16 into casing 18 through perforations 20, as indicated by arrows 22.

It should be noted that while in the illustrated embodiment, and throughout the present description, reference is made to a wellbore which may be generally vertically oriented, the present technique is not intended to be limited to this or any particular well configuration. Thus, where appropriate, the technique may be adapted to directional wells, including inclined or horizontal segments. Moreover, the present technique may be adapted by those skilled in the art to wells including one or more production formations 16, as well as injection zones, gas-producing horizons, and so forth.

In the embodiment shown of FIG. 1, completion system 10 includes a packer 24 secured within casing 18 to divide wellbore 14 into an upper zone 26 and a lower zone 28. In the illustrated configuration, packer 24 is positioned above production perforations 20 to collect wellbore fluids in lower zone 28. Fluids produced by completion system 10, as described more fully below, are passed through upper zone 26 to wellhead 30 located at the earth's surface. In wells located below a body of water, such as in offshore fields, wellhead 30 may be situated at the sea floor.

Packer 24 includes a plurality of passageways for receiving and accommodating both production fluids and equipment control lines and cables. As shown in FIG. 1, packer 24 includes a central portion 32 through which the passageways are formed, and a sealing portion 34 surrounding central portion 32 for exerting a sealing force against the inner periphery of casing 18. As will be appreciated by those skilled in the art, packer 24 may be configured to be secured within casing 18 in various manners, such as via hydraulic inflation, mechanical actuation, and so forth. In a presently preferred embodiment, packer 24 may be generally similar to hydraulically set packers available commercially from Camco International of Houston, Tex. under the designation HECD.

As best shown in FIGS. 1 and 2, in the illustrated embodiment, packer 24 includes a pair of fluid passageways, including a first passageway 36 and a second passageway 38. Passageways 36 and 38 extend through packer 24 between upper zone 26 and lower zone 28. A cable aperture 40 is provided through the packer to permit connection of a power cable as described more fully below. Alternatively, a cable plug-in assembly may be provided in the packer to convey electrical power and data signals across packer 24 between upper zone 26 and lower zone 28. In such cases, electrical cables may include mating connectors (not shown) for conveying power and data signals to and from the earth's surface.

Completion system 10 also includes a pumping system, designated generally by the reference numeral 42, disposed below packer 24, within lower zone 28. While any suitable type of pumping system may be employed for displacement of production fluids from lower zone 28, in the illustrated embodiment, pumping system 10 is a submersible electrical pumping system or ESP, of a type commercially available from Reda of Bartlesville, Okla. Thus, in the illustrated embodiment, the pumping system includes a drive motor 44, a motor protector 46, an inlet section 48, a gas/oil separator 50, a pump 52, and an outlet section 54.

Motor 44 is preferably a polyphase electric motor to which power is supplied via a cable assembly 56. Interior regions of motor 44 may be flooded with a lubricating and cooling medium, such as high quality mineral oil. Cable assembly 56 supplies electrical power to motor 44, and traverses packer 24 through cable aperture 40 as described above. Protector 46 serves to isolate interior regions of motor 44 from wellbore fluids within lower zone 28, and may include labyrinth seals, fluid collection compartments and other isolation structures of a type generally known in the art. Inlet section 48 is positioned above motor protector 46 and includes inlet apertures 58 for drawing wellbore fluids from lower zone 28 into separator 50. Separator 50 draws such wellbore fluids from inlet section 48 and separates liquid components of the wellbore fluids and gaseous components from one another, expelling the gaseous components through an outlet, illustrated as apertures 60 in FIG. 1. Separator 50 may be any of various known separator types, such as a centrifugal or hydrocyclone separator, or a multi-stage structure including both dynamic and static separating elements. Above separator 50, output of liquid components of the wellbore fluids are fed into production pump 52. Pump 52 may include any suitable type of pump, such as a multi-stage centrifugal pump. In the present embodiment, pump 52 is driven by motor 44 via a series of transmission shafts (not shown) traversing motor protector 46, inlet section 48 and separator 50. Pump 52 expresses wellbore fluids through outlet section 54.

Outlet section 54 is secured to packer 24 to express pumped wellbore fluids through passageway 38 and thereby into upper zone 26 of the well. At the same time, gas separated from the wellbore fluids and expressed by separator 50 is transmitted to passageway 36 in packer 24, through which it exits lower zone 28. The gas produced by separator 50 is then transmitted via passageway 36 into a stand of gas production conduit 62. Conduit 62 may comprise any suitable type of production tubing, such as coiled tubing deployed by unrolling from a storage reel during installation of system 10. In the embodiment illustrated in FIG. 1, separator 50 is shown as expressing free gas which collects in an upper region of lower zone 28 and exits via conduit 62. In practice, gas from separator 50 may be conducted directly to passageway 36 for transfer through conduit 62. Conduit 62 permits gas to be produced to a location above the earth surface, where its pressure and flow are controlled via conventional valving (not shown). Where desired, gas from separator 50 may also be compressed and redirected into appropriate locations within well 12, or conveyed to a separate collection point either above or below the earth's surface.

Liquid components of wellbore fluids displaced by pump 52 are expressed through passageway 38 in packer 24 as indicated by arrow 64 in FIG. 1. The wellbore fluids then collect within upper zone 26 in a generally annular region surrounding conduit 62, and are thereby conveyed to wellhead 30. Further conduit 66, or other fluid conveying structures, is provided at wellhead 30 for directing liquids displaced by pump 52 to a desired collection point for further processing. In a presently preferred configuration, conduit 62 is substantially smaller than the internal diameter of casing 18, thereby defining a generally annular region within casing 18 through which production fluids may flow from pump 52. Because of this enhanced cross sectional area surrounding conduit 62, system 10 thereby permits production of relatively high volumes of liquid components of the wellbore fluids as compared to conventional systems wherein such fluids are conveyed through production tubing. Where desired, liners may be provided within casing 18, or a separate conduit may be secured in fluid communication with passageway 38 of packer 24 to convey the liquid components of the wellbore fluids. However, the illustrated configuration permits high volume flow rates of production fluids both in gaseous and liquid phase.

A sectional view through packer 24 is illustrated in FIG. 2. As shown in FIG. 2, the multiple apertures or passageways through packer 24 define volumes through which the produced gas and liquid components of the wellbore fluids flow. Moreover, a crossover passage 68 may be provided between passageway 36 and passageway 38 for permitting fluid communication between the passageways when desired, as described more fully below. Where such a passageway is provided, a valve structure, illustrated diagramatically at reference numeral 70, such as including a valve sleeve 72, is preferably provided to facilitate selective opening and closing of the cross-over passage.

Figure 3:
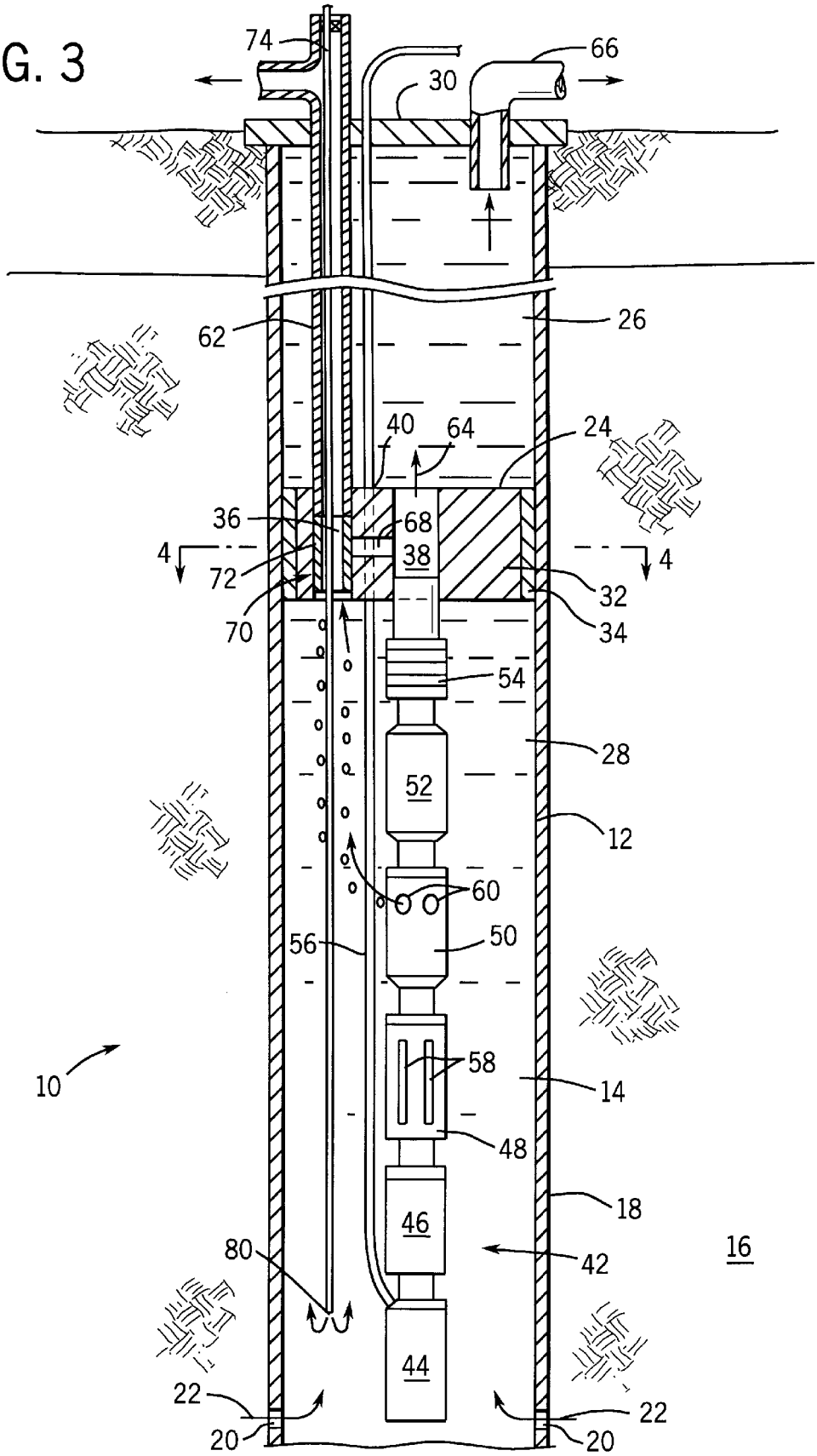
FIG. 3 is an elevational view of an alternative completion system of the type shown in FIG. 1, particularly well suited to injecting chemicals in the well.

FIG. 3 illustrates an alternative configuration of completion system 10 particularly well suited to injection of chemicals into desired regions of the well. The embodiment of FIG. 3 generally includes the components of the completion system of FIG. 1, with the additional of a chemical injection line 74. Injection line 74, which may include a length of conventional steel tubing, is fed through conduit 62, and thereby through passageway 36 in packer 34. A chemical injection pump (not shown) may be coupled to injection line 74 for forcing various chemicals, such as rust inhibitors, viscosity control chemicals, and so forth, into the vicinity of pumping system 42. As best illustrated in FIG. 4, injection line 74 thus includes a central bore 76 through which chemicals may be pumped. The outer diameter of line 74 is preferably substantially smaller than the inner diameter of conduit 62 and aperture 63, thereby facilitating insertion of the line after deployment of the completion system. It should be noted, however, that where desired, line 74 could be pre-installed within conduit 62 prior to deployment of the system.

In the embodiment shown in FIG. 3, a tip 80 of injection line 74 terminates within lower zone 28. This location of tip 80 allows chemicals to be injected at locations such that the chemicals will be drawn into inlet section 48 of pumping system 42. This configuration is particularly useful for injection of materials used to condition wellbore fluids within lower zone 28, or for treatment (e.g. rust inhibition) of components of pumping system 42. However, in the embodiment illustrated, tip 80 of injection line 74 may be positioned so as to inject fluids in a discharge stream flowing from pump 42. Thus, as best shown in FIG. 5, valve 70 within packer 24 may be opened to place passageways 36 and 38 in fluid communication with one another via cross-over passage 68. In the illustrated embodiment, valve 70 is opened by sliding sleeve 72 upwardly, such as by a conventional wireline or hydraulic actuator (not shown). With tip 80 positioned adjacent to passage 68, then, chemicals injected via line 74 may be drawn into the output flow passing through passageway 38. Such arrangements may be well suited to injection of viscosity-altering chemicals or materials which could degrade or corrode pump 52 or upstream components of the pumping system.

Figure 6:
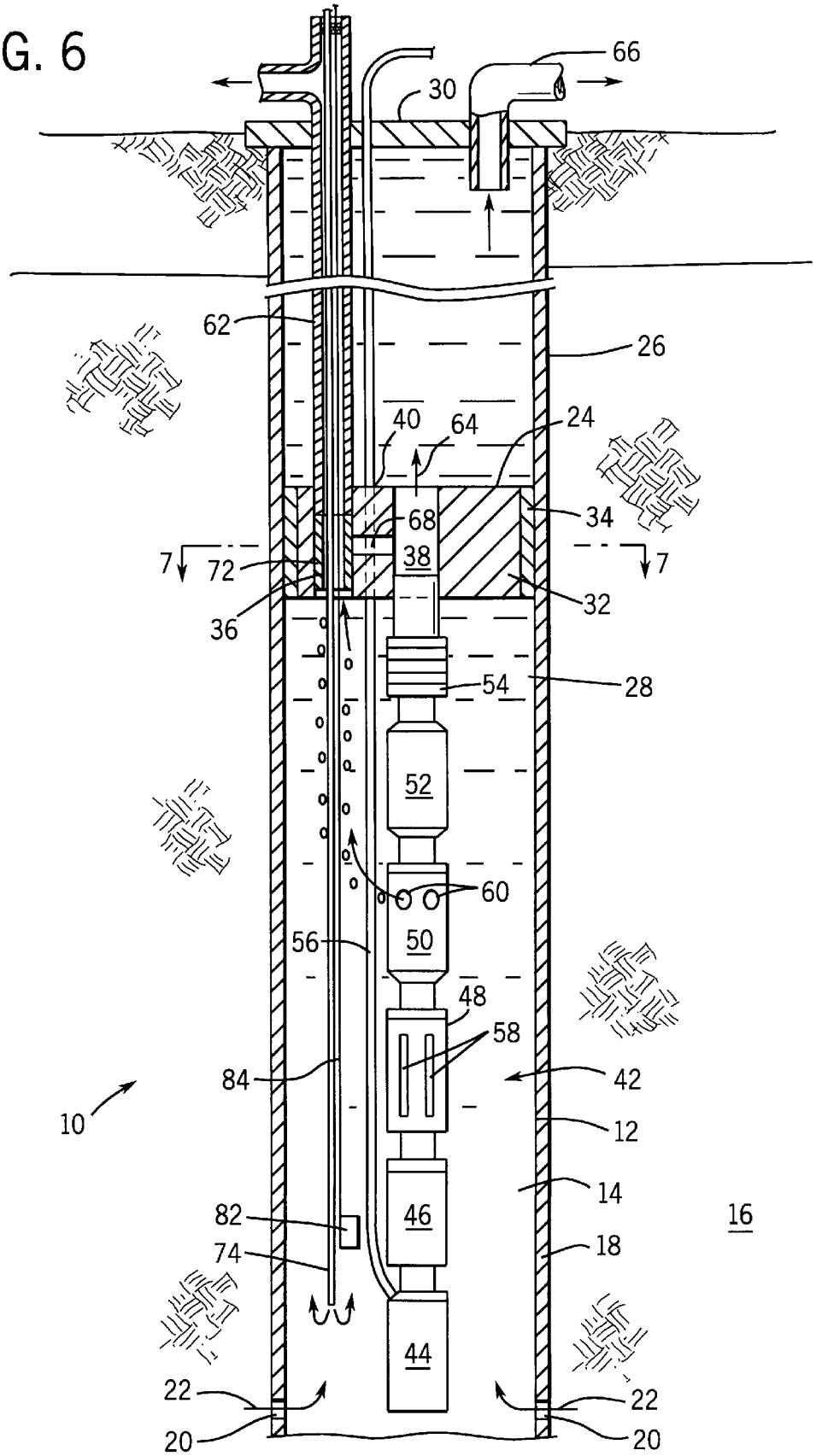
FIG. 6 is a vertical elevational view of a further alternative configuration for a completion system particularly well suited to sensing parameters in the wellbore adjacent to the pumping system.

Completion system 10 also facilitates detection of operational parameters within wellbore 14. In a presently preferred embodiment shown in FIG. 6, an instrument package or sensor unit 82 is lowered into lower zone 28 through conduit 62. Unit 62 may contain various sensors of known type, such as temperature sensors or pressure tranducers. Unit 62 is linked to control circuitry (not shown) above the earth's surface via a support cable 84, which may also serve to transmit control and data signals between unit 62 and interface circuitry above the earth's surface. Alternatively, unit 62 may transmit sensed parameter signals via radio telemetry or another data transmission technique. Moreover, unit 62 may be deployed and retrieved along with a chemical injection line 74, as shown in FIG. 6, or may be positioned completely independently of such injection lines. As shown in FIG. 7, both injection line 74 and sensor unit 62 are preferably sufficiently smaller than the internal dimensions of conduit 62 and passageway 40 to permit one or both to be deployed easily, without obstructing either the conduit or the packer passageway. Moreover, it should be noted that when either the injection line or the sensor unit is positioned within conduit 62, gas may be continuously produced through conduit 62, thereby facilitating chemical injection and parameter sensing without interrupting normal production of system 10.

As will be appreciated by those skilled in the art, the foregoing completion techniques offer several important advantages over conventional well completion systems. For example, the provision of conduit 62 for producing gas separated from wellbore fluids affords a large, low friction loss flow path for liquid components in the region of the wellbore surrounding conduit 62. By virtue of this arrangement, the size and rating of the pumping system may be reduced to accommodate the reduced friction load, while providing production rates similar to or greater than conventional arrangements, resulting in a consequent reduction in initial outlay and subsequent production cost. The reduced friction loss is particularly important for heavy or viscous fluid production. Alternatively, the system may be employed with a higher pumping system capacity than previously known systems, while offering continuous production of oil and gas. Similarly, while many heretofore known systems relied on increased conduit size to carry the desired liquid component flow rates, the present technique permits the use of a reduced dimension coiled tubing for conduit 62, resulting in lower system costs and facilitating system deployment, while still permitting simultaneous oil and gas production when desired. Moreover, the foregoing arrangements greatly enhance system flexibility in chemical injection and parameter sensing without requiring costly interruptions in production of either gas or liquid phase components from the well.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims. For example, while a single conduit 62 has been shown for accommodating gas production, chemical injection and parameter sensing, separate conduits may be provided for one or more of these functions. In such cases, however, an enhanced liquid flow area may be nevertheless defined within upper zone 26 as compared to conventional completion arrangements.

What is claimed is:

1. A well completion system for raising fluids from a well, the system comprising:

a packer for dividing the well into an upper zone and a lower zone, the packer having first and second passageways extending between the first and second zones;

a pumping system positioned in the lower zone, the pumping system including a pump and a drive motor coupled to the pump, the pumping system being operative to displace fluids from the lower zone through the first passageway in the packer to the earth's surface via a first fluid path; and a second fluid path separate from the first fluid path and extending from the earth's surface through a fluid conduit to the second passageway in the packer for uninterrupted fluid communication between the earth's surface and the lower zone via the second passageway.

2. The well completion system of claim 1, the packer being operable to selectively fluidicly couple the first and second passageways, the system further comprising a fluid injection line extending from the earth's surface through the fluid conduit to the second passageway of the packer for injection of fluid into the first fluid path.

3. The well completion system of claim 1, further comprising a fluid injection line extending from the earth's surface through the fluid conduit to the lower zone for injection of fluid into the lower zone.

4. The well completion system of claim 1, further comprising an instrumentation unit positioned in the lower zone through the fluid conduit, the instrumentation unit being configured to detect at least one parameter of the well and to transmit signals representative of the parameter to the earth's surface.

5. The well completion system of claim 1, wherein the first fluid path is defined between the fluid conduit and an interior peripheral surface of the well.

6. The well completion system of claim 1, wherein the pumping system includes a liquid/gas separator, and wherein gas from the separator is directed from the lower zone to the second fluid path via the second passageway and liquid from the separator is displaced by the pump.

7. A well completion system for raising fluids from a well, the system comprising:

a packer for separating the well into a lower zone and an upper zone, the packer having first and second passageways extending between the lower and upper zones;

a pumping system positioned in the lower zone, the pumping system including a liquid/gas separator for separating wellbore fluids into substantially gaseous components and substantially liquid components, a drive motor, and a pump operatively coupled to the drive motor for displacing fluids from the lower zone to the upper zone via the first passageway; and a fluid conduit extending from the earth's surface to the second passageway, the fluid conduit transmitting gas from the separator to a collection location.

8. The well completion system of claim 7, wherein the pump transfers substantially liquid components of the wellbore fluids to the earth's surface through a flow path defined between the wellbore and the fluid conduit.

9. The well completion system of claim 7, further comprising a chemical injection line extending through the fluid conduit to the lower zone for injecting a chemical into the lower zone from a location above the earth's surface.

10. The well completion system of claim 7, wherein the packer includes a crossover passage extending between the first and second passageways, and means for selectively opening and closing the crossover passage.

11. A well completion system for raising fluids from a well, the system comprising:

a packer dividing the well into a lower zone and an upper zone, the packer having first and second passageways extending between the lower and upper zones;

a pumping system positioned in the lower zone, the pumping system including a drive motor operatively coupled to a pump for transferring wellbore fluids from the lower zone to the earth's surface via the first passageway;

a fluid conduit extending from the earth's surface to the second passageway; and a chemical injection line extending from the earth's surface and through the fluid conduit for injecting a chemical into the well, wherein the well completion system is operable to selectively inject chemicals into the pumping system intake or discharge.

12. The well completion system of claim 11, wherein the chemical injection line terminates in the lower zone for injecting a chemical at a location adjacent to or below an intake section of the pump.

13. The well completion system of claim 11, wherein the packer includes a crossover passage extending between the first and second passageways, and means for selectively opening and closing the crossover passage.

14. The well completion system of claim 13, wherein the chemical injection line terminates at a location adjacent to or below the crossover passage for injecting a chemical on a discharge side of the pump.

15. The well completion system of claim 11, further including an instrumentation unit positioned in the lower zone via the fluid conduit and the second passageway.

16. A method for producing fluid from a well, the method comprising the steps of:

positioning a completion system in the well above a production horizon, the completion system comprising a packer for separating the well into lower and upper zones, the packer having first and second passageways extending between the lower and upper zones, a pumping system disposed in the lower zone and including a pump operatively coupled to a drive motor, a discharge side of the pump being in fluid communication with the first passageway, and a fluid conduit extending from the earth's surface to the second passageway for direct fluid communication with the lower zone; and applying power to the motor to drive the pump and thereby to displace wellbore fluids through an annular region defined between an inner peripheral surface of the well and the fluid conduit to the earth's surface.

17. The method of claim 16, wherein the pumping system further includes a liquid/gas separator for separating substantially gaseous components from substantially liquid components of wellbore fluids.

18. The method of claim 17, including the further step of producing substantially gaseous components of wellbore fluids through the fluid conduit.

19. The method of claim 16, including the further step of disposing a chemical injection line in the fluid conduit and injecting a chemical into the well through the chemical injection line.

20. The method of claim 19, wherein the chemical injection line extends from the earth's surface to a location within the lower zone and the chemical is injected on an inlet side of the pump.

21. The method of claim 19, wherein the packer includes a crossover passage extending between the first and second passageways, and wherein the chemical injection line extends between the earth's surface and a location adjacent to or below the crossover passage for injection the chemical on an outlet side of the pump.

22. The method of claim 19, wherein the packer includes means for selectively opening and closing the crossover passage, and wherein the method includes the further step of opening the crossover passage prior to injection of the chemical.

23. The method of claim 16, comprising the further steps of removably positioning an instrumentation unit in the lower zone through the fluid conduit and sensing a parameter of the well via the instrumentation unit.

24. The method of claim 23, comprising the further step of transmitting a signal representative of the parameter to a location above the earth's surface.

* * * * *